US006023852A

United States Patent [19]

Mulligan et al.

[11] Patent Number: 6,023,852

[45] Date of Patent: Feb. 15, 2000

[54] DRYING APPARATUS FOR COATED OBJECTS

[75] Inventors: David J. Mulligan, Palm Springs; Charles R. Orman, Redlands, both of Calif.

[73] Assignee: Sunkist Growers, Inc., Ontario, Calif.

[21] Appl. No.: 09/151,711

[22] Filed: Sep. 11, 1998

[51] Int. Cl.[7] ..... F26B 19/00

[52] U.S. Cl. ..... 34/216; 34/209

[58] Field of Search ..... 34/209, 210, 216, 34/217

[56] References Cited

U.S. PATENT DOCUMENTS 4,299,036 11/1981 Schregenberger ..... 34/16
4,610,886 9/1986 Buller-Colthurst ..... 426/233
5,537,758 7/1996 Guarise ..... 34/216

*Primary Examiner*—Henry Bennett
*Assistant Examiner*—Malik N. Drake
*Attorney, Agent, or Firm*—Linda M. Robb

[57] ABSTRACT

A drying apparatus is provided for drying objects such as citrus fruit that has been coated with an aqueous coating such as wax. The apparatus includes a housing that is divided into four distinct zones, two each above and below a conveyor for conveying fruit through the dryer. An indirect fired heater is provided, and fans that circulate drying air at high velocity in a reverse air flow pattern. The housing of the dryer is constructed in a unique shape so each successive zone is alternately converging and diverging. With this arrangement, air is balanced in the treatment zones and passes over the fruit twice, first in one direction, and then in the other, to achieve even and complete drying.

17 Claims, 1 Drawing Sheet

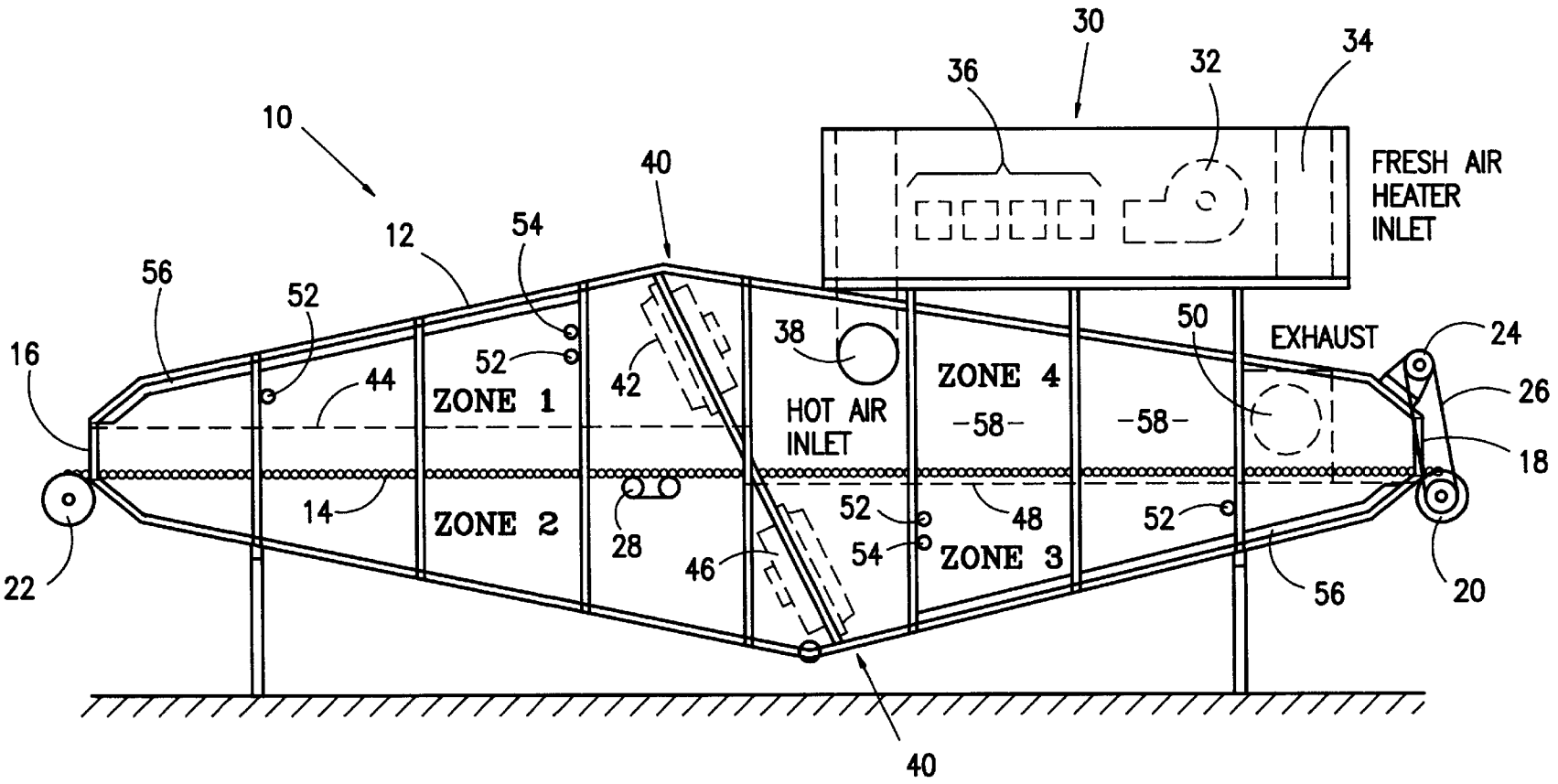
FRESH AIR
HEATER
INLET
EXHAUST
HOT AIR
INLET
ZONE 1
ZONE 2
ZONE 3
ZONE 4
10
12
14
16
18
20
22
24
26
28
30
32
34
36
38
40
42
44
46
48
50
52
54
56
58

DRYING APPARATUS FOR COATED OBJECTS

BACKGROUND OF THE INVENTION

The present invention relates to a drying apparatus and more particularly to an apparatus for drying fruit that has been treated with an aqueous coating.

In the commercial preparation of fruit, such as citrus fruit, for market, it is common to treat the fruit with an aqueous coating of wax or other material to replace the natural wax which is removed during the washing process, thereby serving to protect the fruit during periods of storage and handling, during transit to market, and ultimately, to enhance the appearance of the fruit at the marketplace. Once this coating has been applied, it is desirable to dry the fruit to facilitate handling, packing, and shipping.

Prior devices that have been used for this purpose have employed relatively high operating temperatures, in the range of 120 to 160 degrees Fahrenheit, low velocity air flow, in the range of 200 to 300 feet per minute, and direct fired heaters to elevate the temperature of the drying air. Direct fired heaters have been employed to reduce the cost of the apparatus but have unnecessarily increased the cost of operation. Because a direct fired heater exhausts combustion gases, including water vapor, into the drying chamber, much higher drying temperatures are necessary to accomplish the desired drying effect. These higher temperatures, in turn, create higher surface temperatures in the fruit, which have been implicated in the occurrence of rind breakdown in citrus fruit either through direct stress on the fruit or through the formation of a "glassy" layer within the wax, which can impede the natural transfer of gases through the coating, e.g. reduce the transfer of carbon dioxide out of the fruit as well as oxygen into the fruit. Moreover, the high dryer temperatures of the prior art increase the overall temperature of the fruit, further exacerbating the inefficiency of these systems by requiring greater amounts of energy to cool the fruit for subsequent storage and handling. In addition, especially in the case of citrus fruit, when insufficient velocity of airflow is used, uneven or incomplete drying can occur because citrus continuously releases water through respiration as well as from the wax, causing humid air to accumulate between pieces of fruit or between layers of fruit on the conveyor.

To overcome some of these drawbacks, other prior devices have used chilled air to dry the fruit, based on the principle of using refrigerated coils to remove humidity from the air. These systems can be engineered to remove moisture from the fruit, but they experience other problems. Although the wax coating of the fruit is dry when the fruit exits the dryer, the fruit is also cold, resulting in severe sweating under humid conditions.

SUMMARY OF THE INVENTION

It is therefore an object of the present invention to provide a novel drying apparatus for drying objects, such as fruit, which apparatus overcomes the problems experienced with prior devices.

A primary object of the invention is to provide a dryer that is effective and efficient in the setting of an overall fruit packing facility.

Another object of the invention is to provide a drying apparatus that is effective while operating at relatively low temperatures in order to avoid potentially damaging fruit by exposure to excessive heat.

Another object of the invention is to provide for drying of fruit with high velocity air flow in order to achieve even and complete drying of the fruit coating.

Another object of the invention is to provide a drying apparatus that uses indirect heat to achieve the desired drying temperature thereby preventing the counter-productive introduction of water vapor and other combustion gases into the fruit treatment environment.

It is yet another object of the invention to provide a fruit drying apparatus that is capable of achieving the above objects and is still easy to maintain, efficient in operation, and non-disruptive to the working environment of a fruit handling and packing facility.

These and other objects of the invention are achieved by providing a uniquely shaped drying apparatus through which fruit or other objects are conveyed and within which mildly heated air is forced at high velocity through a series of four zones. The drying air is heated by an indirect fired heater and passes over the fruit or other objects to be dried twice within the drying apparatus, first in one direction and then in the opposite direction, in order to achieve even and complete drying.

The present invention contemplates a dryer apparatus that is characterized by a unique diverging and converging overall shape through which fruit or other objects to be dried are conveyed on a continuous conveyor means. Drying air is forcibly withdrawn at a very high volume flow rate from a diverging chamber and forced into an adjacent converging chamber where it is then caused to pass over the fruit or other objects to be dried. After passing over the fruit, the drying air is collected in another chamber of diverging shape and is again forcibly withdrawn from that chamber and forced at a high volume flow rate into yet another converging chamber. In that chamber, the air again passes over the fruit or objects to be dried, this time in the opposite direction from the first pass, and is collected on the other side of the fruit in the diverging chamber from which it was first withdrawn. Using this reverse airflow system allows for large air flows to pass twice over the fruit in opposite directions thereby minimizing the possibility of pockets of dead air where humidity can accumulate.

In addition, the apparatus of the present invention is preferably provided with removable side panels that permit easy access to the interior of the apparatus for the purpose of conducting regular maintenance. These panels and other housing panels are preferably provided with a suitable layer of insulation for the dual purpose of conserving heat loss and providing sound insulation, and the supply air intake and exhaust ducts are preferably conducted to a point outside of the area where the apparatus is located. With this arrangement, the apparatus of the present invention is easy to maintain, efficient in operation, and does not introduce unwanted noise, heat, or humidity to the work space surrounding the apparatus.

These and other aspects of the invention will be more apparent from the following description of the preferred embodiment thereof when considered in connection with the accompanying drawings and appended claims.

BRIEF DESCRIPTION OF THE DRAWING

The present invention is illustrated by way of example and not limitation in the accompanying drawing in which like references indicate similar parts, and in which:

FIG. 1 is a side elevational view, taken partly in section, of the drying apparatus of the present invention.

DETAILED DESCRIPTION OF THE PREFERRED EMBODIMENT

A dryer apparatus embodying this invention is generally shown at 10 in FIG. 1 and is comprised of a housing 12 through which extends a continuous conveyor 14 for carrying fruit or other objects to be dried within the housing. The conveyor 14 can be of conventional design and enters the housing 12 at its entrance end 16 and extends longitudinally through the central portion of the housing 12 emerging from the housing at its exit end 18. After exiting the housing 12, the conveyor 14 is drawn over a drive roller 20 and returns to the entrance end 16 on a path that is below and external of the housing 12. At the entrance end 16 of the housing 12, the conveyor 14 passes over an entrance end roller 22 to complete the continuous circuit of the conveyor means. In the embodiment shown, the conveyor 14 is powered by a variable speed drive motor 24 that provides motive force to the drive roller 20 through a drive belt or chain 26.

In operation, fruit or other objects to be dried are deposited on the conveyor 14 where it passes on top of the entrance end roller 22 and is then conveyed through the housing 12 toward the exit end 18 where it is transferred to another conveyor (not shown) for further processing or handling. Due to the high air velocity used in the apparatus of the present invention, it is not necessary to provide for excessive fruit rotation during the drying process. In fact, such rotation is undesirable as it tends to increase scuffing of the wax and detracts from the appearance of the finished product. Instead, fruit contact points are broken and the fruit is rotated only once at or about the mid-point in the dryer. For this purpose, contact points are broken by a conveyor lifter 28 of conventional and well known design, and the conveyor lifter 28 is located at or about the mid-point of the procession of the conveyor 14 through the dryer 10.

Dryers intended to remove moisture from an aqueous coating of wax applied to fruit, such as citrus fruit, generally function by increasing the surface temperature of the fruit to a temperature sufficient to raise the vapor pressure of the water in the wax to a level above the partial pressure of water in the air inside the dryer. The surface temperature of the fruit is normally increased by adding heat to the air in the dryer. In the apparatus of the present invention, for the purpose of adding heat to the air in the dryer, an air heater, indicated generally at 30, draws supply air into the heater 30 by force of a heater fan 32. The fan 32 draws air into a fresh air inlet 34. Inside the heater 30, air is heated through a series of coils or heat exchangers 36, and that heated air is forced into the dryer 10 via a hot air inlet 38.

As indicated above, prior dryers intended for this purpose have been characterized by inefficiency and other problems that have remained unsolved. In accordance with the present invention, a dryer is provided, especially suited for drying aqueous coatings on fruit, which dryer employs a unique, four-chamber air flow pattern using high velocity air flow that passes the fruit twice in opposite directions and at relatively low temperature. To achieve this, a uniquely shaped diverging and converging housing 12 is used in combination with high powered fans, indicated generally at 40, to move the drying air through the four chambers and over the fruit for a uniform drying effect. In addition, the heater 30 is preferably an indirect heater that is capable of maintaining the desired treatment temperature inside the dryer 10 without introducing water vapor and other undesirable combustion gases into the fruit drying atmosphere.

The fans 40 are mounted within the housing 12 and serve to force drying air to circulate through the chambers of the dryer 10. A first fan or set of fans 42 is mounted in the upper mid-portion of the housing 12 and is positioned to force a large volume of air into a portion of the housing designated as Zone 1 in the drawing. Zone 1 is located at the entrance end of the housing 12 and above the conveyor 14. From the perspective of the fan or fans 42, air is forced by the fan 42 into a chamber (Zone 1) that converges from the end of the chamber defined by fan 42 toward the entrance end of the housing 16. This forcing of air at a high volume rate into Zone 1, and the converging shape of Zone 1, combine to create a uniform air pressure above the fruit on the conveyor defining the bottom of Zone 1.

To further facilitate uniform flow of air down through the layer of fruit on the conveyor 14, an air distribution panel 44 can be interposed in the air flow path above the conveyor 14 in Zone 1. This air distribution panel 44 can be comprised of perforated sheet metal, or any other desired material, and can be provided with any desired degree of openness. An openness of 35 to 65 percent is currently preferred.

Below the portion of the conveyor that passes through Zone 1 is a chamber, designated as Zone 2 in the drawing, that is characterized by a diverging shape from the entrance end 16 of the housing 12 toward its mid-portion. The mid-portion end of diverging Zone 2 is defined by a second fan or set of fans 46, which serve to draw air at a high volume flow rate out of Zone 2 and into a downstream chamber, designated in the drawing as Zone 3. The resulting reduced pressure in Zone 2, when combined with the high uniform pressure maintained in Zone 1 by the first fan 42, pulls air downwardly past the fruit on the conveyor 14 at a high and uniform velocity across the portion of the conveyor defining the border between Zones 1 and 2.

Zone 3 is located below the conveyor 14 and runs from the mid-portion of the dryer 10 to the exit end 18 of the housing 12. The second fan or set of fans 46 withdraws air from the diverging chamber Zone 2 and forces that air at a high volume flow rate into the adjacent, converging chamber Zone 3, which is located below the conveyor 14 and downstream of Zones 1 and 2. As is the case with Zone 1, this forcing of air at a high volume flow rate into Zone 3, and the converging shape of Zone 3, combine to create a uniform air pressure below the conveyor defining the top of Zone 3. Again, as in Zone 1, a second air distribution panel 48 can be interposed in the air flow path below the conveyor in Zone 3.

Across the conveyor 14 from converging chamber Zone 3 is another diverging chamber designated as Zone 4 in the drawing. As can be seen in the drawing, it is from this diverging chamber Zone 4 that the first fan or set of fans 42 withdraws air to create the uniform air pressure in Zone 1. The resulting reduced pressure in Zone 4 pulls air upwardly past the fruit on the conveyor 14 at a high and uniform velocity across the portion of the conveyor 14 that defines the border between Zones 3 and 4.

More specifically, in the preferred embodiment of the present invention, the conveyor 14 traverses a total length of about 35 feet within the housing 12 and is about 3 feet to 9 feet wide. The first fan 42 is either a set of two 30 inch diameter, 10 horsepower fans or a single 36 inch diameter, 15 horsepower fan that blows air at a volumetric flow rate of up to 30,000 cubic feet per minute per foot of dryer width into Zone 1, creating a positive pressure in Zone 1 of about 2 inches of water and a negative pressure in Zone 4. The second fan 46 is also preferably a set of two 30 inch diameter, 10 horsepower fans that maintain a similar positive pressure in Zone 3 and negative pressure in Zone 2. The resulting pressure differentials between Zones 1 and 2, and between Zones 3 and 4, cause air in the dryer 10 to flow downwardly across the fruit in Zone 1 and upwardly through the fruit in Zone 4 at a velocity in excess of 1000 feet per minute. Further, the air distribution panels 44 and 48 in the currently preferred embodiment of the invention have a degree of openness of less than 50%.

In order to achieve the desired drying effect in the present dryer using a very high velocity air flow, it is not necessary to maintain extremely high operating temperatures within the housing 12. It has been found that by maintaining the temperature of the air in Zone 1 at a maximum of about 95 to 100 degrees Fahrenheit, sufficient heat is transferred to the surface of the fruit thereby increasing the vapor pressure of the water in the wax, and excellent drying results are achieved. Moreover, as the fruit is conveyed through Zone 1, the high velocity air flow removes water vapor from the aqueous surface coating of the fruit as well as from the gaps between individual pieces of fruit.

For the purpose of maintaining the desired temperature within the dryer 10 without introducing water vapor and other undesirable combustion gases, the heater 30 is preferably an indirect, gas-fired heater instead of a direct fired type heater. This arrangement eliminates unnecessary introduction of water vapor and other combustion gases, including carbon monoxide and nitrogen oxides, into the drying environment as well as into the packing environment, if the dryer is installed indoors. If a direct fired heater were used, as has been common in dryers in the past, water vapor and other combustion gases are injected into the dryer substantially increasing the partial pressure of water in the dryer air. Accordingly, in order to raise the water vapor pressure of the water in the wax above the high partial water pressure of the drying air, relatively high operating temperatures were required.

In the present invention, by using an indirect fired heater, the combustion gases used to heat the heat exchangers 36 are vented outside of the dryer 10, and if the dryer is installed indoors, the gases are preferably vented outside of the building through appropriate ducting (not shown). In order to obtain supply air having a minimum humidity, the fresh air inlet 34 is also preferably connected by appropriate ducting (not shown) to a source of air outside of the building in which the dryer 10 might be installed.

When the preferred embodiment of the present invention, as described above, is in operation, between 5,000 and 10,000 cubic feet per minute of air is passively exhausted to the outside through a vent 50 in the side wall of the housing 12 in Zone 4. To compensate for the loss of that vented humid air, make-up fresh air is heated by heater 30 to a temperature necessary, after being combined with return air from Zone 4, to maintain the temperature in Zone 1 at a maximum of about 95 to 100 degrees Fahrenheit. All make-up fresh air is preferably brought in from outside of the packing environment because outside air is generally less humid than the air inside of a fruit packing facility. In addition, in order to monitor and maintain the desired temperature and humidity conditions within the dryer 10, temperature sensors 52 and humidity sensors 54 may be placed inside the dryer 10, and can be monitored by an operator outside of the dryer. Preferably, these sensors 52 and 54 are placed in Zones 1 and 3, as shown.

Lastly, in order to reduce the noise of operation and to provide for efficient retention of heat, the housing 12 is preferably lined with a suitable layer of insulation 56. Also, the panels 58 comprising one side of the housing 12 are preferably removable to facilitate easy maintenance of the interior of the dryer 10. Only a few or all of the panels 58 may be arranged to be removable.

It will be apparent to those skilled in the art that the drying apparatus of the present invention provides an efficient and effective means for drying objects, particularly fruit having an aqueous coating of wax or citrus coating thereon, that overcomes problems that existed in previous dryers. The apparatus of the present invention is capable of achieving effective drying while operating at a relatively low drying temperature, thereby minimizing damage to the fruit being dried, conserving energy, and reducing the cost of operation. Moreover, the apparatus is arranged to cooperate well with other processes typically encountered in a packing facility, and does so without having negative effect of the work environment, by minimizing noise of operation and eliminating the introduction of noxious fumes into the work place.

Various modifications and changes may be made by those having ordinary skill in the art without departing from the spirit and scope of the invention. Therefore, it must be understood that the illustrated embodiment has been set forth only for the purpose of example, and that it should not be taken as limiting the invention as defined in the following claims.

The words used in this specification to describe the present invention are to be understood not only in the sense of their commonly defined meanings, but to include by special definition, structure, material, or acts beyond the scope of the commonly defined meanings. The definitions of the words or elements of the following claims are, therefore, defined in this specification to include not only the combination of elements which are literally set forth, but all equivalent structure, material, or acts for performing substantially the same function in substantially the same way to obtain substantially the same result.

In addition to the equivalents of the claimed elements, obvious substitutions now or later known to one of ordinary skill in the art are defined to be within the scope of the defined elements.

The claims are thus to be understood to include what is specifically illustrated and described above, what is conceptually equivalent, what can be obviously substituted, and also what essentially incorporates the essential idea of the invention.

We claim:

1. An apparatus for drying objects, said apparatus comprising:

a housing defining a treatment area within said housing;

a conveyor for carrying said objects into and through said treatment area in said housing;

a heater for heating drying air to be circulated in said treatment area of said housing;

air circulating means for circulating drying air over said objects as said objects are conveyed through said treatment area;

said apparatus further characterized in that said treatment area is divided into four zones, a first zone on one side of said conveyor and adjacent an entrance end of said treatment area, a second zone on the other side of said conveyor and adjacent said entrance end of said treatment area, a third zone adjacent an exit end of said treatment area and on the same side of said conveyor as said second zone, and a fourth zone adjacent said exit end of said treatment area and on the same side of said conveyor as said first zone;

said air circulating means including a first fan means between said fourth and said first zones and arranged to draw air from said fourth zone and force that air into said first zone, said air circulating means further including a second fan means between said second and said third zones and arranged to draw air from said second zone and force that air into said third zone.

2. The apparatus of claim 1 wherein said housing is shaped to define said treatment area such that each successive zone is alternatingly converging and diverging in shape in the general direction of air flow therein.

3. The apparatus of claim 1 wherein said first zone is above said conveyor, said second zone is below said conveyor, said third zone is below said conveyor, and said fourth zone is above said conveyor.

4. The apparatus of claim 3 wherein said second zone is adjacent to and immediately below said first zone and is in pneumatic communication with said first zone through said conveyor and said objects on said conveyor, and said fourth zone is adjacent to and immediately above said third zone and is in pneumatic communication with said third zone through said conveyor and said objects on said conveyor.

5. The apparatus of claim 1 wherein an air distribution panel is disposed within said first zone and interposed between said first fan means and said conveyor.

6. The apparatus of claim 1 wherein an air distribution panel is disposed within said third zone and interposed between said second fan means and said conveyor.

7. The apparatus of claim 1 wherein said objects are fruit having an aqueous coating such as wax thereon.

8. The apparatus of claim 1 wherein said heater is in communication with one of said zones and heats supply air for introduction into that zone to maintain a desired temperature within said treatment area.

9. The apparatus of claim 8 wherein said one of said zones is the fourth zone, and said fourth zone also includes an exhaust vent to release from the treatment area a portion of the air circulating in the treatment area.

10. The apparatus of claim 9 wherein said apparatus is installed in a building and said vent is arranged to exhaust air outside of said building.

11. The apparatus of claim 1 wherein said heater is an indirect fired heater.

12. The apparatus of claim 11 wherein said apparatus is installed in a building and said heater exhausts heating exhaust gases outside of said building.

13. The apparatus of claim 1 wherein said apparatus is installed in a building, said heater includes a fresh air inlet, and said fresh air inlet is arranged to draw air into said heater from outside of said building.

14. The apparatus of claim 11 wherein said heater is arranged to maintain a temperature in the treatment area of up to a maximum of 95 degrees Fahrenheit.

15. The apparatus of claim 1 wherein said air circulation means is arranged to produce air flow over the objects on the conveyor between said first and second zones, and over the objects on the conveyor between said third and fourth zones, at a velocity of at least 1000 feet per minute.

16. The apparatus of claim 1 wherein said housing includes access panels to permit access to the interior of the treatment area.

17. The apparatus of claim 1 wherein said housing includes a layer of insulation.

* * * * *